US005862955A

United States Patent [19]

Albini et al.

[11] Patent Number: 5,862,955

[45] Date of Patent: Jan. 26, 1999

[54] CREAMY SUBSTANCE DISPENSER HAVING NON-RETURN VALVE

[75] Inventors: Giovanni Albini; Tommaso Ruscitti, both of Milan; Franco Carlappi, Pianello Valtidone, all of Italy

[73] Assignee: Ter S.R.L., Opera Mi, Italy

[21] Appl. No.: 889,060

[22] Filed: Jul. 7, 1997

[51] Int. Cl.[6] ..... B65D 37/00

[52] U.S. Cl. ..... 222/212; 222/496

[58] Field of Search ..... 222/207, 212, 222/496, 386

[56] References Cited

U.S. PATENT DOCUMENTS

| | | | |
|---|---|---|---|
| 2,270,794 | 1/1942 | Feldmar | 222/496 |
| 3,954,209 | 5/1976 | Raymond | 222/496 |
| 5,125,539 | 6/1992 | Schneider . | |
| 5,197,637 | 3/1993 | Naumann . | |
| 5,377,880 | 1/1995 | Moretti . | |
| 5,492,251 | 2/1996 | Albini et al. . | |
| 5,577,640 | 11/1996 | Albini et al. . | |

FOREIGN PATENT DOCUMENTS

| | | |
|---|---|---|
| 0447335 | 9/1991 | European Pat. Off. . |
| 0452260 | 10/1991 | European Pat. Off. . |
| 0600286 | 6/1994 | European Pat. Off. . |

*Primary Examiner*—Gregory L. Huson
*Attorney, Agent, or Firm*—Oblon, Spivak, McClelland, Maier & Neustadt, P.C.

[57] ABSTRACT

A creamy substance dispenser has a substantially rigid casing bounding a cylindrical chamber fillable with a creamy substance. A movable piston is slidable on the surface of the chamber for sealingly closing one end of the chamber. A dispensing chamber is separated from the cylindrical chamber by a transverse wall having apertures communicating the cylindrical chamber with the dispensing chamber and appendices projecting about the apertures. A profiled body formed of an elastically deformable material is fixed to the rigid casing and defines an outwardly facing portion of the dispensing chamber. The profiled body has a delivery hole and at least one rib projecting in proximity to the delivery hole and securely engaged with the appendices. A non-return valve has an appendix shaped to seal the delivery hole, and is positioned in the dispensing chamber to prevent return flow of creamy substance in the dispensing chamber to the cylindrical chamber. A guide member cooperates with the transverse wall to guide the non-return valve for movement between a position in which the appendix of the non-return valve seals the delivery hole and a position in which the non-return valve seals the aperture in the transverse wall. An elastically yieldable member reacts between the non-return valve and the transverse wall to urge the non-return valve to the position in which the appendix of the non-return valve seals the delivery hole.

3 Claims, 2 Drawing Sheets

CREAMY SUBSTANCE DISPENSER HAVING NON-RETURN VALVE

BACKGROUND OF THE INVENTION

1. Field of the Invention

This invention relates to a dispenser for creamy substances such as creams for cosmetic use, of the type comprising a container bounding a cylindrical chamber containing the creamy substance and closed at one end by a piston movable in a sealed manner along said chamber.

2. Description of the Related Art

Many known types of dispensers are provided with mechanical devices for moving the piston only in that direction which reduces the volume of the chamber containing the creamy substance. Reference can be made for example to U.S. Pat. No. 421,255, EP-A-0051790, EP-A-0084638, U.S. Pat. No. 3,088,636 and U.S. Pat. No. 3,768,705. These dispensers have a relatively complex structure, are costly and their operation is often difficult and unsatisfactory.

Dispensers are also known having two separate chambers mutually communicating via a non-return valve. Of the two chambers, one is cylindrical and is intended only to act as a container for the creamy substance, it being closed at one end by a sealed piston freely slidable within the chamber. The other chamber is the dispensing chamber and is at least partially deformable (to allow compression of that part of the substance contained in it and drawn by suction from the cylindrical chamber via a non-return valve). It comprising a dispensing nozzle provided with a closure element to allow the substance to pass only to the outside.

When dispensing ceases, the deformable part of the dispensing chamber returns to its rest position to close the nozzle and generate a vacuum which draws the substance from the cylindrical chamber to the dispensing chamber via the non-return valve.

These types of dispensers (described for example in U.S. Pat. No. 4,821,926, U.S. Pat. No. 4,890,773, U.S. Pat. No. 4,913,322, U.S. Pat. No. 4,946,076, U.S. Pat. No. 5,176,291 and EP-A-0 686 431) have a rather complex mechanical structure with rigid component parts slidable one on another, causing considerable operating problems as a result of the possible hardening of the creamy substances within the respective dispensing chambers, difficult assembly and consequent relatively high cost.

To overcome the aforementioned problems, improvements have been proposed to the dispensers of the latter type, by forming with elastically deformable material an entire wall bounding the dispensing chamber. By squeezing and deforming this wall, the cream contained in this chamber is directly compressed, so that it emerges through the discharge nozzle.

A series of dispensers of this type are illustrated in EP-A-0376097, but these dispensers have a very complex structure, requiring, inter alia, the presence and operation of levers for squeezing the deformable wall of the dispensing chamber.

A simpler and more economical version of the dispenser having a dispensing chamber bounded by an elastically deformable wall is represented in U.S. Pat. No. 5,377,880 (and in the corresponding European patent EP-A-0600286) in which the dispensing nozzle consists of a hole provided in the deformable wall. This hole is positioned in correspondence with the free end of a rigid peg fixed to project into the dispensing chamber. When in the rest state, the deformable wall is elastically urged towards the peg such that the end of the peg is reliably forced into the hole to seal it. As this sealing depends only on the elastic compression force (which necessarily cannot be high) developed by the elastic wall on the end of the pin, and as the dispensing chamber is filled with creamy substance which tends to urge the elastic wall outwards, it follows that the sealing of the dispensing chamber is very uncertain. Moreover, as the cream is dispensed to the outside only when the orifice defining the discharge hole is deformed elastically such that only a small portion of the surface of this hole is withdrawn from the adjacent surface of the peg, it follows that, to be dispensed to the outside, the cream must pass through a very small aperture (because most of the hole remains obstructed by the end of the pin), and hence dispensing is difficult and very slow.

SUMMARY OF THE INVENTION

The main object of the present invention is therefore to provide a creamy substance dispenser of the type comprising a cylindrical chamber with a movable piston communicating with a dispensing chamber via at least one aperture closed by a non-return valve and in which the dispensing chamber is partly bounded by an elastically deformable wall, said dispenser being formed from a very small number of components easily assembled together such that the dispenser is very economical, provides a perfect seal during closure and allows easy dispensing of the creamy substance during the use of the dispenser.

This and further objects are attained by a dispenser comprising a substantially rigid casing bounding a cylindrical chamber fillable with a creamy substance, said chamber being closed at one end by a movable piston freely slidable under sealed conditions along the cylindrical surface of the chamber, which at its other end is bounded by a transverse wall traversed by at least one aperture connecting said cylindrical chamber to a dispensing chamber, the outwardly facing portion of which is defined by a profiled body fixed to said rigid casing and formed of an elastically deformable material in which there is provided at least one delivery hole, in correspondence with said aperture there being provided a non-return valve which enables the creamy substance to pass freely from the cylindrical chamber to the dispensing chamber. There projects from said body of elastic material, in proximity to said delivery hole, at least one rib which securely engages corresponding appendices projecting from the opposing surface of said transverse wall about said aperture in the wall, said non-return valve being housed in said dispensing chamber and being provided with guide members which constrain it to said transverse wall while enabling it to freely move within said chamber between a position in which the valve seals said aperture in said transverse wall and a position in which an appendix projecting from said valve is superposed on said delivery hole to seal it. Elastically yieldable members are provided which react between said valve and said transverse wall to urge said valve appendix towards and against said delivery hole.

Preferably said valve consists of a discoidal member, the periphery of which is superposed on said aperture and is elastically deformable within the dispensing chamber, said elastically yieldable members consisting of elastically flexible appendices projecting from said discoidal member and having their free end facing the opposing surface of said transverse wall.

BRIEF DESCRIPTION OF THE DRAWINGS

The structure, operation and the characteristics of the dispenser according to the invention will be more apparent from the description of a preferred embodiment thereof, given hereinafter with reference to the accompanying drawings, in which.

DETAILED DESCRIPTION OF THE PREFERRED EMBODIMENT

Figure 1:
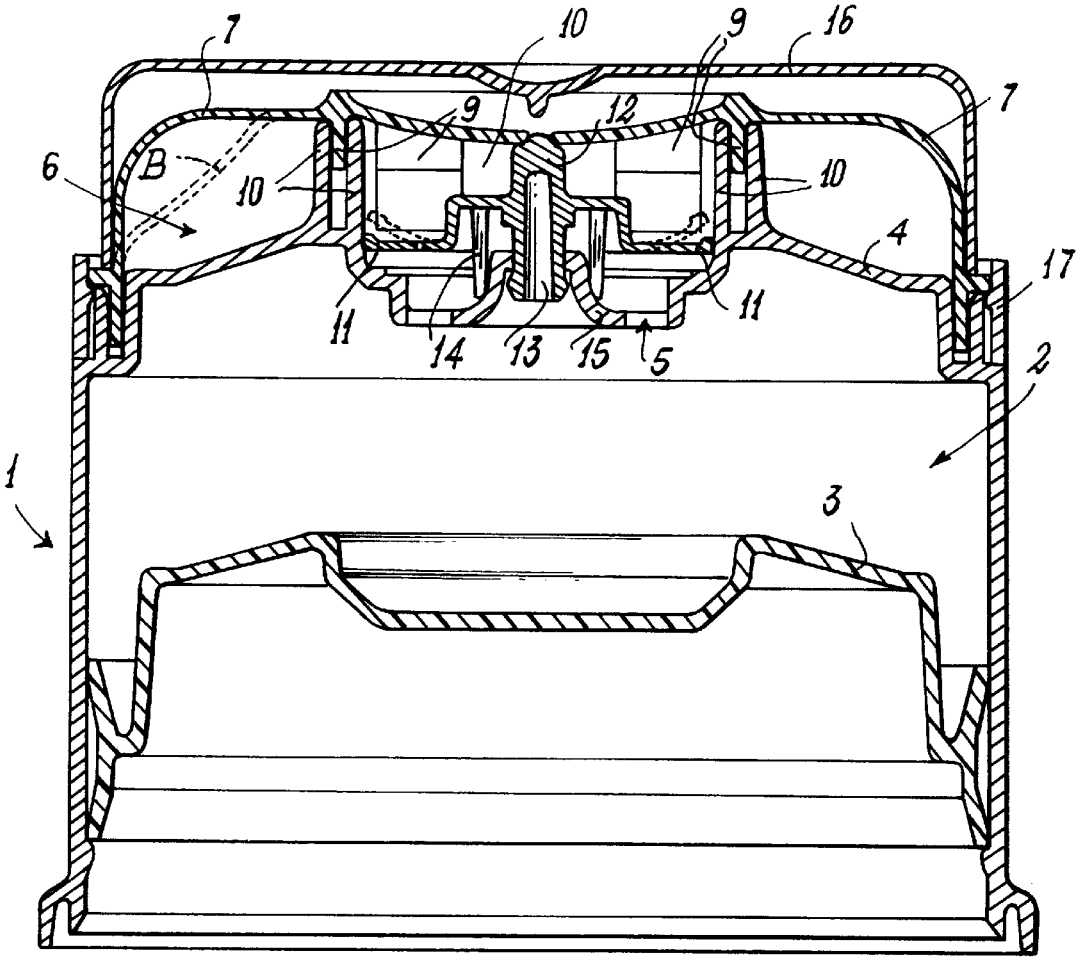
FIG. 1 is a longitudinal section through the dispenser, shown in its closed position.

The dispenser shown on the drawings comprises a substantially rigid casing 1 (for example of glass or plastic) bounding a cylindrical chamber 2 fillable with a creamy substance, such as a cream for cosmetic use.

The chamber 2 is closed from below (with respect to FIGS. 1 and 3) by a piston 3 sealedly slidable along the cylindrical surface of said chamber, which is closed at its other end by a transverse wall 4 in which there are provided apertures 5 connecting the chamber 2 to a dispensing chamber 6 which is bounded from above (again with respect to said figures) by a profiled cap 7 formed of elastically deformable material, and at the center of which there is provided a delivery hole 8.

Figure 3:
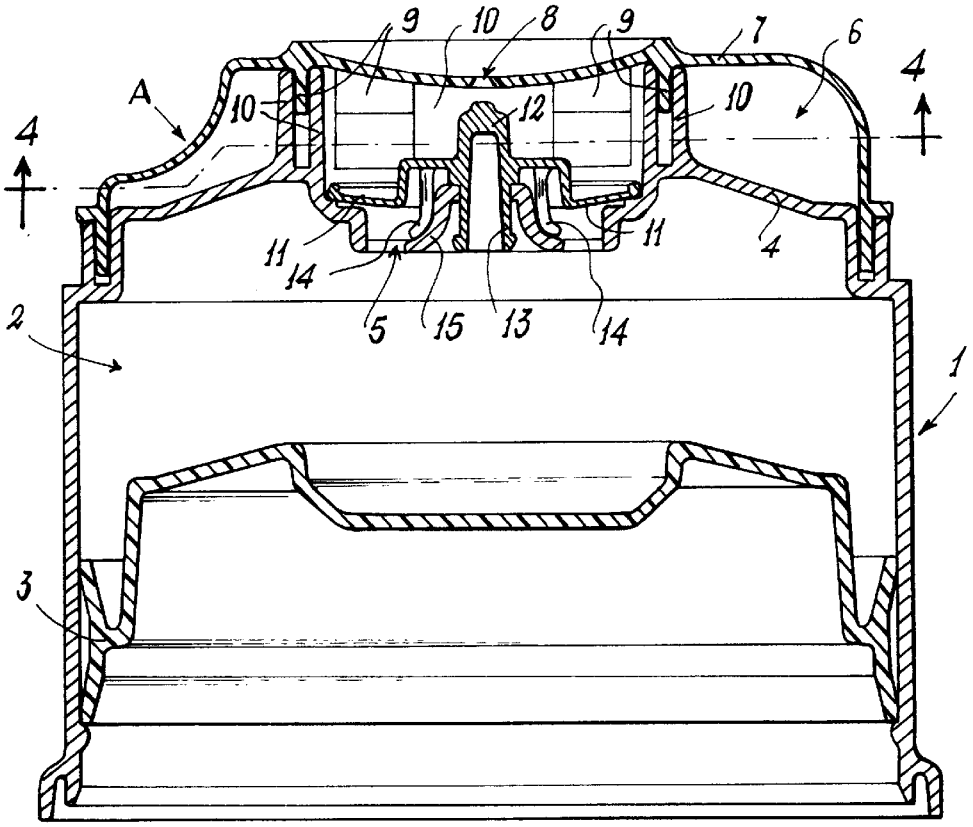
FIG. 3 is a longitudinal section through the dispenser, shown during dispensing.
Figure 4:
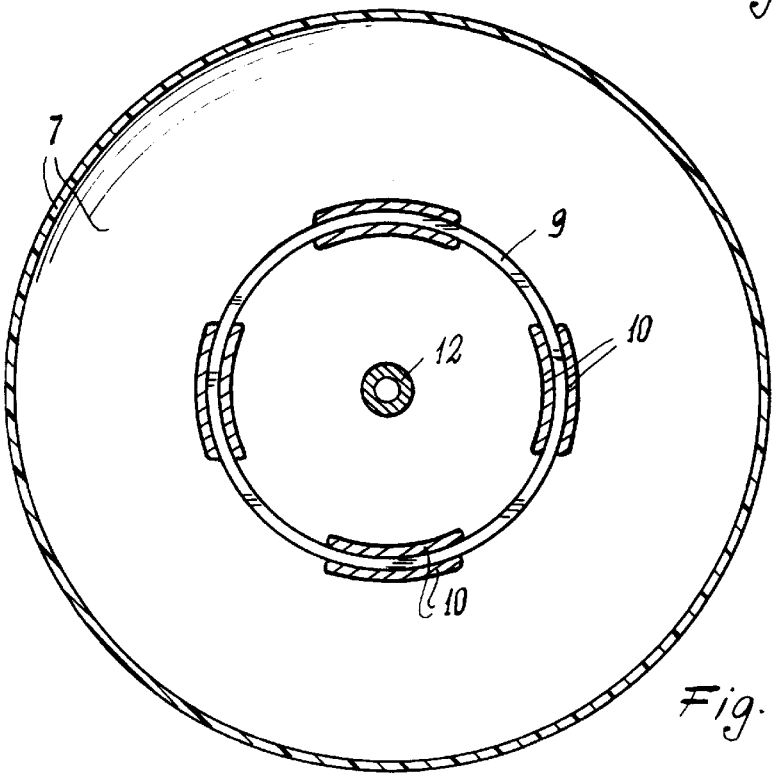
FIG. 4 is a cross-section through the dispenser on the line 4—4 of FIG. 3.

The cap 7 is securely fixed to the casing 1 by the peripheral free edge of the cap being forced into and retained within a corresponding annular groove provided in the outer surface of the casing, as can be easily seen in FIGS. 1 and 3.

A basic characteristic of the dispenser described herein is that a continuous rib 9 projects from the cap 7 about the entire hole 8 (instead of the continuous rib a plurality of separate appendices could be provided) and is inserted and retained between corresponding pairs of appendices 10 (four separate pairs of appendices 10 are shown) projecting from the opposing surface of the wall 4. By virtue of this structure, that portion of the cap 7 within the rib 9 remains taut during the use of the dispenser, deforming only little or not at all.

In the dispensing chamber 6 there is provided a non-return valve consisting of a discoidal member 11 of flexible material overlying the apertures 5. From the central part of the discoidal member 11 there upwardly projects an appendix 12, the free end of which extends towards the hole 8 on which it becomes superposed to seal said hole, when the dispenser is in its rest state. From the discoidal member 11 there downwardly projects a profiled appendix 13 (coaxial with the appendix 12) which is inserted in and freely slidable within a guide hole provided in the wall 4, as can be easily seen from FIGS. 1 and 3.

Figure 2:
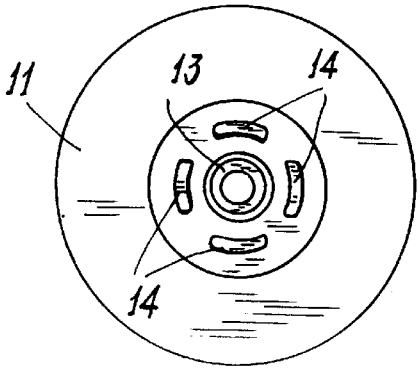
FIG. 2 is a view from below, with respect to FIG. 1, of the non-return valve forming part of the dispenser.

From the discoidal member 11 there project about the appendix 13 flexible appendices 14 (four in number in the illustrated embodiment and easily seen from FIG. 2, which represents a front view of the isolated discoidal member from below), the free ends of which rest on a substantially conical surface of a portion 15 of the wall 4.

The dispenser is formed from a total of only four component parts, which are easily and economically constructed and assembled.

If required, the cap 7 can be protected by a protection cover 16 (FIG. 1) which can be provided with a tearable security tab 17 of known type, commonly used to guarantee that bottles in general have not been tampered with.

It will now be assumed that the two chambers 2 and 6 are filled with a cosmetic cream, that the cover 16 has been removed and that the dispenser is in the rest state of FIG. 1 in which the upper end of the valve appendix 12 is urged by the appendices 14 to seal the delivery hole 8. On pressing (in the direction of the arrow A of FIG. 3) on that part of the cap 7 external to the rib 9, the cream present in the chamber 6 is initially pressurized (it should be noted that the free edge of the discoidal member 11 of the valve seals against a cylindrical surface of a seat housing the stem of the discoidal member), causing the lowering of the discoidal member (again with respect to FIGS. 1 and 3), the appendix 12 of which withdraws from the hole 8, so allowing the cream to pass to the outside, while the appendices 14 are flexed elastically outwards, as shown in FIG. 3.

As soon as the pressure on the cap ceases (or as soon as the pressure of the cream present in the chamber 6 falls), the flexible appendices immediately lift the discoidal member upwards, with the appendix 12 sealing the hole 8. That part of the cap 11 which had been deformed tends to return elastically to its initial rest position by passing through intermediate positions, such as that shown by dashed lines in FIG. 1 and indicated by the letter B. As the hole 8 is closed, the return of the cap to its undeformed shape puts the cream present in the chamber 6 under vacuum, with consequent transfer from the chamber 2 to the chamber 6 of a quantity of cream equal to that which had been dispensed. During this stage, the piston 3 also rises along the cylindrical chamber, and the edges of the discoidal member flex within the chamber 6 (as shown by dashed lines in FIG. 1) to hence withdraw from the surface against which said edges would otherwise seal. When the cream pressure in the two chambers 2 and 6 reaches the same value, the valve reassumes the position indicated by full lines in FIG. 1.

The aforegoing description highlights the ease of use and the small number of components of the dispenser, the fact that air is never present within the chamber 6, that no metal parts are used (although the flexible appendices 14 could be replaced by a spring if desired), and that the only movable member of the dispenser is the discoidal member with its appendices, acting both as a non-return valve and as the valving member.

We claim:

1. A creamy substance dispenser comprising:

a substantially rigid casing bounding a cylindrical chamber fillable with a creamy substance;

a movable piston slidable on the surface of said chamber for sealingly closing one end of said chamber;

a dispensing chamber separated from said cylindrical chamber by a transverse wall, said transverse wall having at least one aperture to communicate said cylindrical chamber with said dispensing chamber, and appendices projecting from said transverse wall about said at least one aperture;

a profiled body formed of an elastically deformable material, said profiled body being fixed to said rigid casing and defining an outwardly facing portion of said dispensing chamber, said profiled body having at least one delivery hole and at least one rib projecting from said profiled body in proximity to said at least one delivery hole and securely engaged with said appendices projecting from said transverse wall;

a non-return valve having an appendix shaped to seal said delivery hole, said non-return valve being positioned in said dispensing chamber to prevent return flow of creamy substance in the dispensing chamber to the cylindrical chamber;

a guide member cooperating with the transverse wall to guide the non-return valve for movement in said dispensing chamber between a position in which said appendix of said non-return valve seals said delivery hole and a position in which said non-return valve seals said at least one aperture in said transverse wall; and an elastically yieldable member reacting between said non-return valve and said transverse wall to urge said non-return valve to the position in which said appendix of said non-return valve seals said delivery hole.

2. The dispenser of claim 1, wherein said non-return valve comprises an elastically deformable discoidal member having a periphery superimposable on said at least one aperture in said transverse wall.

3. The dispenser of claim 2, wherein said elastically yieldable member comprises an elastically flexible appendix projecting from said discoidal member toward said transverse wall.

* * * * *